US009834987B2

(12) United States Patent
Lo

(10) Patent No.: US 9,834,987 B2
(45) Date of Patent: Dec. 5, 2017

(54) FOLDABLE PICKING LADDER CART

(71) Applicant: ROMP ENTERPRISE CO., LTD., Taichung (TW)

(72) Inventor: Chung-Chi Lo, Miaoli County (TW)

(73) Assignee: ROMP ENTERPRISE CO., LTD., Taichung (TW)

( * ) Notice: Subject to any disclaimer, the term of this patent is extended or adjusted under 35 U.S.C. 154(b) by 30 days.

(21) Appl. No.: 15/009,175

(22) Filed: Jan. 28, 2016

(65) Prior Publication Data

US 2016/0319600 A1 Nov. 3, 2016

(30) Foreign Application Priority Data

Apr. 30, 2015 (TW) ..... 104206630 U

(51) Int. Cl.
*E06C 1/393* (2006.01)
*E06C 1/397* (2006.01)

(52) U.S. Cl.
CPC ..... *E06C 1/393* (2013.01); *E06C 1/397* (2013.01)

(58) Field of Classification Search
CPC ... E04G 1/30; E04G 1/34; E06C 1/397; E06C 7/16; E06C 7/50; E06C 1/393; F16B 7/105
See application file for complete search history.

(56) References Cited

U.S. PATENT DOCUMENTS 1,439,388 A * 12/1922 Willett ..... E06C 1/393 182/113
2,362,170 A * 11/1944 Swaisgood ..... E06C 5/06 14/72.5
2,970,668 A * 2/1961 Snyder ..... B25H 5/00 182/116
4,602,890 A * 7/1986 Duda ..... F16B 7/105 403/105
6,105,719 A * 8/2000 Lensing ..... B25H 5/00 182/116
6,196,560 B1 * 3/2001 Ohlsson ..... B62B 1/12 182/20

(Continued)

FOREIGN PATENT DOCUMENTS

DE 3604497 A1 * 8/1987 ..... F16B 7/105
EP 1500754 A2 * 1/2005 ..... E04G 1/28
JP JP 04368280 A * 12/1992 ..... B62B 3/04

*Primary Examiner* — Colleen M Chavchavadze
(74) *Attorney, Agent, or Firm* — Lynette Wylie; Apex Juris, pllc.

(57) ABSTRACT

A foldable ladder cart including a main shaft, an upper loading board, a lower loading board, an upper brace, and a lower brace is provided. The upper loading board is connected to the main shaft, and is pivotally movable between a first and a second position. The lower loading board is connected to the main shaft, and is pivotally movable between a third and a fourth positions. The upper brace is connected to the upper loading board and the main shaft; the lower brace is connected to the main shaft and the lower loading board. When the upper and the lower braces are in supporting positions, the upper loading board and the main shaft are in the first and the third positions. When the upper and the lower braces are in folded positions, the upper loading board and the main shaft are in the second and the fourth positions.

6 Claims, 9 Drawing Sheets

(56) References Cited

U.S. PATENT DOCUMENTS

| | | | | |
|---|---|---|---|---|
| 6,651,774 | B2 * | 11/2003 | Yoo | E06C 1/397 182/129 |
| 6,802,391 | B2 * | 10/2004 | Ganiere | B64F 1/315 182/1 |
| 7,448,470 | B2 * | 11/2008 | Brown | B66F 11/042 182/63.1 |
| 8,136,632 | B2 * | 3/2012 | Gabriel | E06C 7/165 182/107 |
| 8,752,810 | B2 * | 6/2014 | Anderson | F16F 9/56 188/300 |
| 9,400,080 | B2 * | 7/2016 | Chen | F16M 11/28 |
| 9,573,609 | B2 * | 2/2017 | Yu | E06C 7/02 |
| 2002/0179134 | A1 * | 12/2002 | Suh | E04H 15/46 135/141 |
| 2003/0156923 | A1 * | 8/2003 | Winkler | F16B 7/105 411/552 |
| 2006/0062632 | A1 * | 3/2006 | Jang | E04H 15/46 403/109.6 |
| 2012/0048647 | A1 * | 3/2012 | Green | E06C 1/16 182/111 |
| 2014/0041963 | A1 * | 2/2014 | O'Shea | E06C 1/393 182/64.1 |

* cited by examiner

FOLDABLE PICKING LADDER CART

The current application claims a foreign priority to application number 104206630 filed on Apr. 30, 2015 in Taiwan.

BACKGROUND OF THE INVENTION

1. Technical Field

The present invention relates generally to a conveying appliance used for warehousing, and more particularly to a foldable picking ladder cart.

2. Description of Related Art

In storage facilities such as warehouses, materials and goods are stocked on the shelves in different categories. For the convenience of conveying, picking ladder carts are commonly used in moving the materials and goods to and from the shelves, and especially in short-distance transportation. Additionally, a conventional picking ladder cart has a multilayered structure, or a large loading area, which provides a larger loading capacity to reduce the transportation cost.

However, with such design, a conventional picking ladder cart occupies a large space when it is not in use, which causes a waste of storage space. Moreover, it may become a threat to industrial safety when workers are walking in the storage facility.

BRIEF SUMMARY OF THE INVENTION

In view of the above, the primary objective of the present invention is to provide a foldable picking ladder cart to solve the problem of the waste of storage space.

The present invention provides a foldable picking ladder cart including a main shaft, an upper loading board, a lower loading board, an upper brace, and a lower brace. The upper loading board is pivotally connected to the main shaft, wherein the upper loading board is pivotally movable between a first position and a second position relative to the main shaft. The lower loading board is pivotally connected to another end of the main shaft, wherein the main shaft is pivotally movable between a third position and a fourth position relative to the lower loading board. A plurality of wheels are installed at a bottom of the lower loading board. The upper brace is pivotally connected to the upper loading board and the main shaft with two ends thereof respectively. The upper brace is pivotally movable between a supporting position and a folded position; when the upper brace is in the supporting position, the upper loading board is in the first position; when the upper brace is in the folded position, the upper loading board is in the second position. The lower brace is pivotally connected to the main shaft and the lower loading board with two ends thereof respectively. The lower brace is pivotally movable between a supporting position and a folded position; when the lower brace is in the supporting position, the main shaft is in the third position; when the lower brace is in the folded position, the main shaft is in the fourth position.

Whereby, with the design of the upper brace and the lower brace, when the upper and the lower braces are in the supporting positions, the braces can firmly support the main shaft and the upper loading board. When the foldable picking ladder cart is not in use, the braces are in the folded positions to reduce the occupied volume and the waste of storage space.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
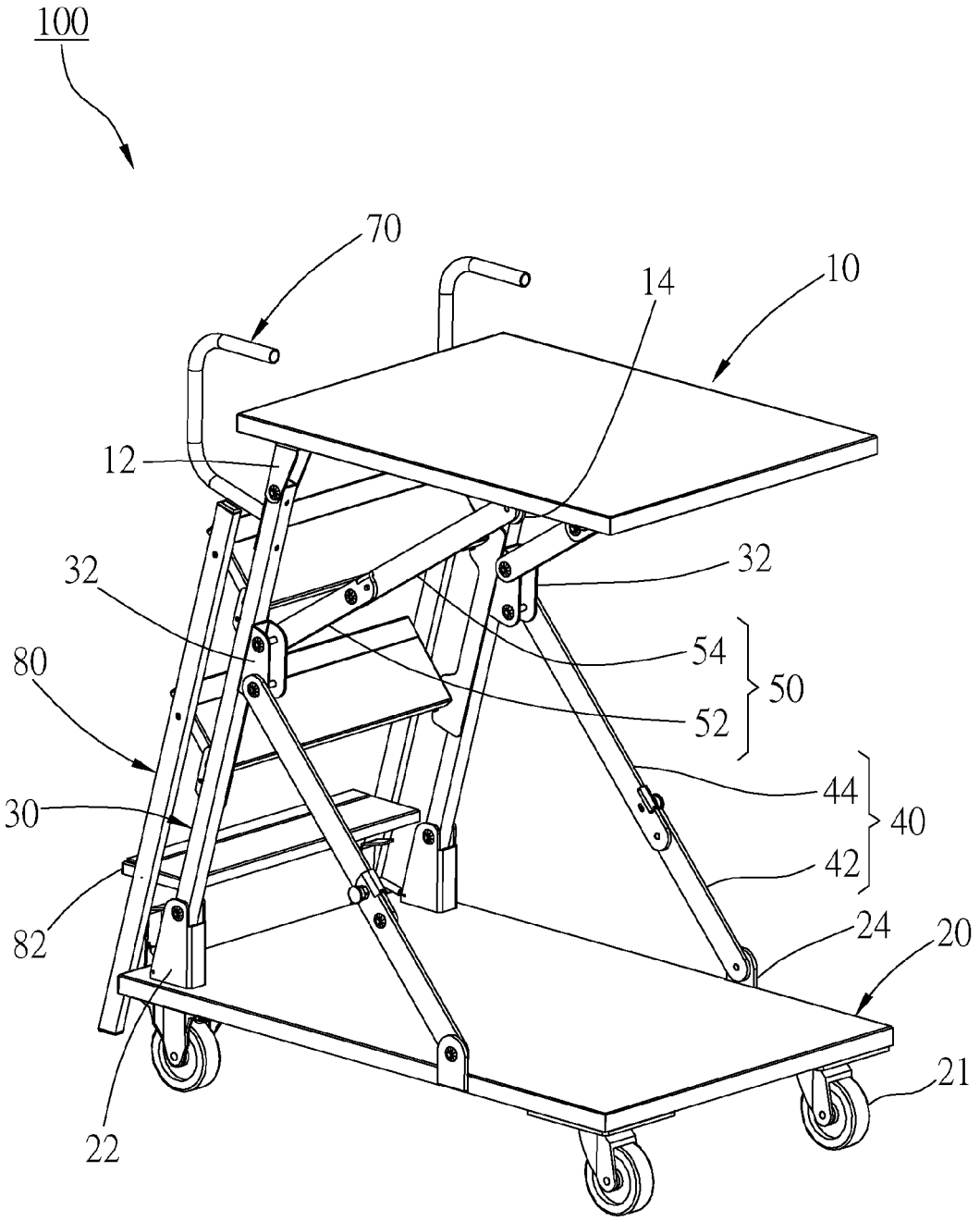
FIG. 1 is a perspective view of a preferred embodiment of the present invention, showing the foldable picking ladder cart before being folded.

As shown in FIG. 1, a foldable picking ladder cart 100 of the preferred embodiment of the present invention includes an upper loading board 10, a lower loading board 20, two main shafts 30, two lower braces 40, and two upper braces 50.

Both the upper loading board 10 and the lower loading board 20 are rigid boards for holding goods, wherein a plurality of wheels 21 are installed at a bottom of the lower loading board 20. The main shaft 30 has a stiff supporting structure, and pivotally connected to a first connecting member 12 of the upper loading board 10 and the first connecting member 22 of the lower loading board 20 with two ends thereof respectively.

Figure 2:
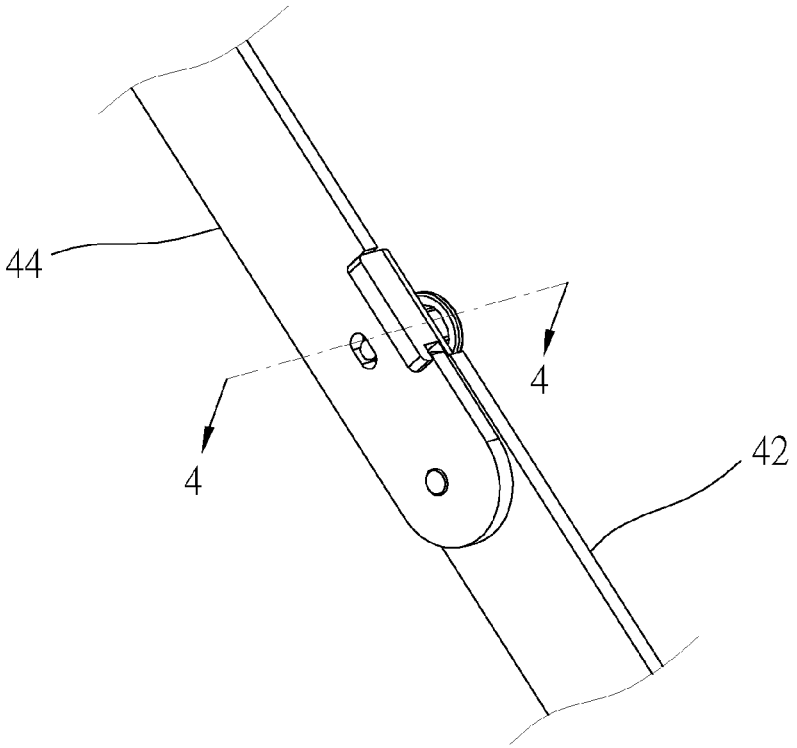
FIG. 2 is a partial enlarged view of the preferred embodiment, showing the relation of the first support and the second support of the lower brace in the supporting position.
Figure 3:
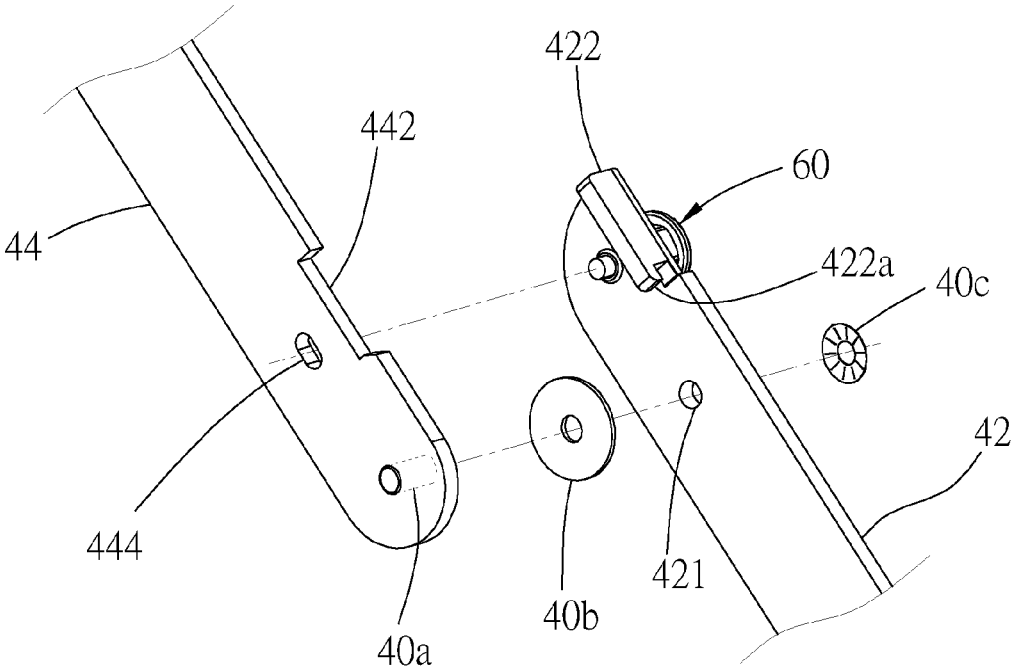
FIG. 3 is a partial exploded view of FIG. 2.

The two lower braces 40 are the same in structure, wherein each of the lower braces 40 is pivotally connected to a second connecting member 22 of the lower loading board 20 and a connecting member 32 of the main shaft 30 with two ends thereof respectively. Each of the lower braces 40 includes a first support 42 and a second support 44 as shown in FIG. 2 and FIG. 3. The first support 42 and the second support 44 are pivotally connected to each other through a shaft 40*a*, wherein the shaft 40*a* is connected to the second support 44 with one end thereof, and passes through a washer 40*b* and a shaft bore 421 of the first support 42, and is fixed to the first support 42 with the other end thereof through a fixing member; in the preferred embodiment, the fixing member is a cap nut 40*c*. When the first support 42 and the second support 44 are arranged in a straight line with a straight angle formed between the two supports 42 and 44, the lower brace is defined to be in a supporting position shown as FIG. 6. On the other hand, when the first support 42 and the second support 44 overlap, the lower brace is defined to be in a folded position shown as FIG. 10.

The first support 42 a is bent to form a stop piece 422 protruding toward the second support 44, wherein an engaging portion 422*a* is formed on the stop piece 422; the second support 44 has a recession 442 thereon corresponding to the stop piece 422. When the first support 42 and the second support 44 are arranged in a straight line, the stop piece 422 is fitted into the recession 442, and the engaging portion 422*a* engages an outer surface of the second support 44, which is illustrated in FIG. 2. With the design of the stop piece 422 and the corresponding recession 442, the structural strength of the lower brace 40 is increased, which prevents a separation of the first support 42 and the second support 44 caused by an external force.

Figure 4:
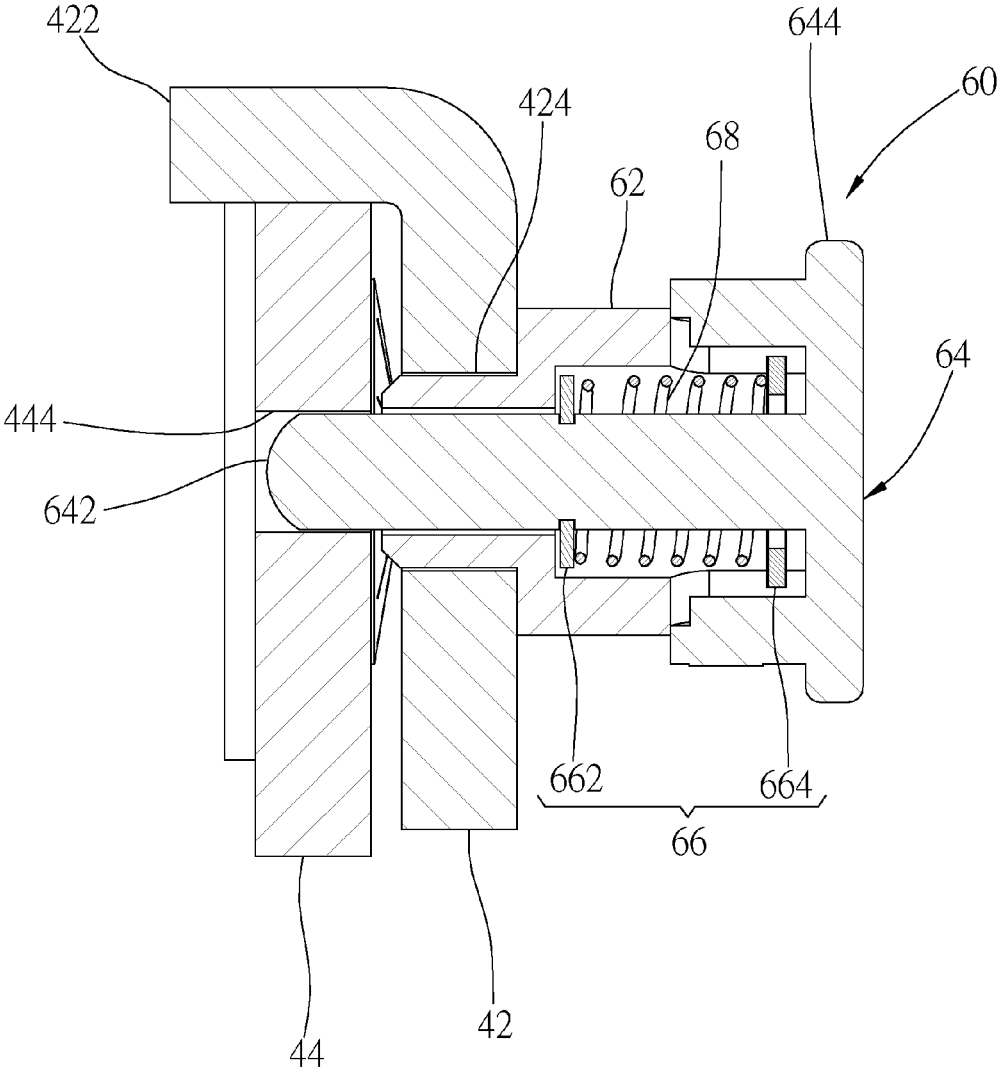
FIG. 4 is a sectional view along the 4-4 line in FIG. 2, showing the locking device is in the locking state.

The foldable picking ladder cart 100 further has a locking device 60 installed on the lower brace 40, depicted in FIG. 3 and FIG. 4. The locking device 60 includes a positioning base 62, a positioning pin 64, a confining unit 66, and a spring 68, wherein the positioning base 62 has a hollow portion therein, and the first support 42 and the second support 44 have a positioning bore 424 and 444 respectively. The hollow portion of the positioning base 62 aligns with the positioning bore 424 of the first support 42; an end of the positioning base 62 is inserted into the positioning bore 424 of the support 42, and is fixed to the first support 42.

The positioning pin 64 has a body 642 and a head 644 connected to each other, wherein the body 642 is detachably inserted into the hollow portion of the positioning base 62 which is located in the positioning bore 424 of the first support 42, and is also inserted into the positioning bore 444 of the second support 44; the head 644 abuts against another end of the positioning base 62.

The confining unit 66 in the preferred embodiment includes a confining member 662 and a protruding ring 664, wherein the confining member 662 is a ring fixed to an outer surface of the body 642; the protruding ring 664 is another ring fixed to an inner surface of the positioning base 62, and is located in the hollow portion of the positioning base 62.

The spring 68 is provide in the hollow portion of the positioning base 62, and abuts against the confining member 662 and the protruding ring 664 with two ends thereof respectively. The spring 68 applies an elastic force to the positioning pin 64 to keep the body 642 of the positioning pin 64 staying in the positioning bore 444 of the second support 44, and to keep the first support 42 and the second support 44 being arranged in a straight line, which is defined as a locking state of the locking device 60. In such state, the first support 42 and the second support 44 are fixedly in the supporting position.

Figure 5:
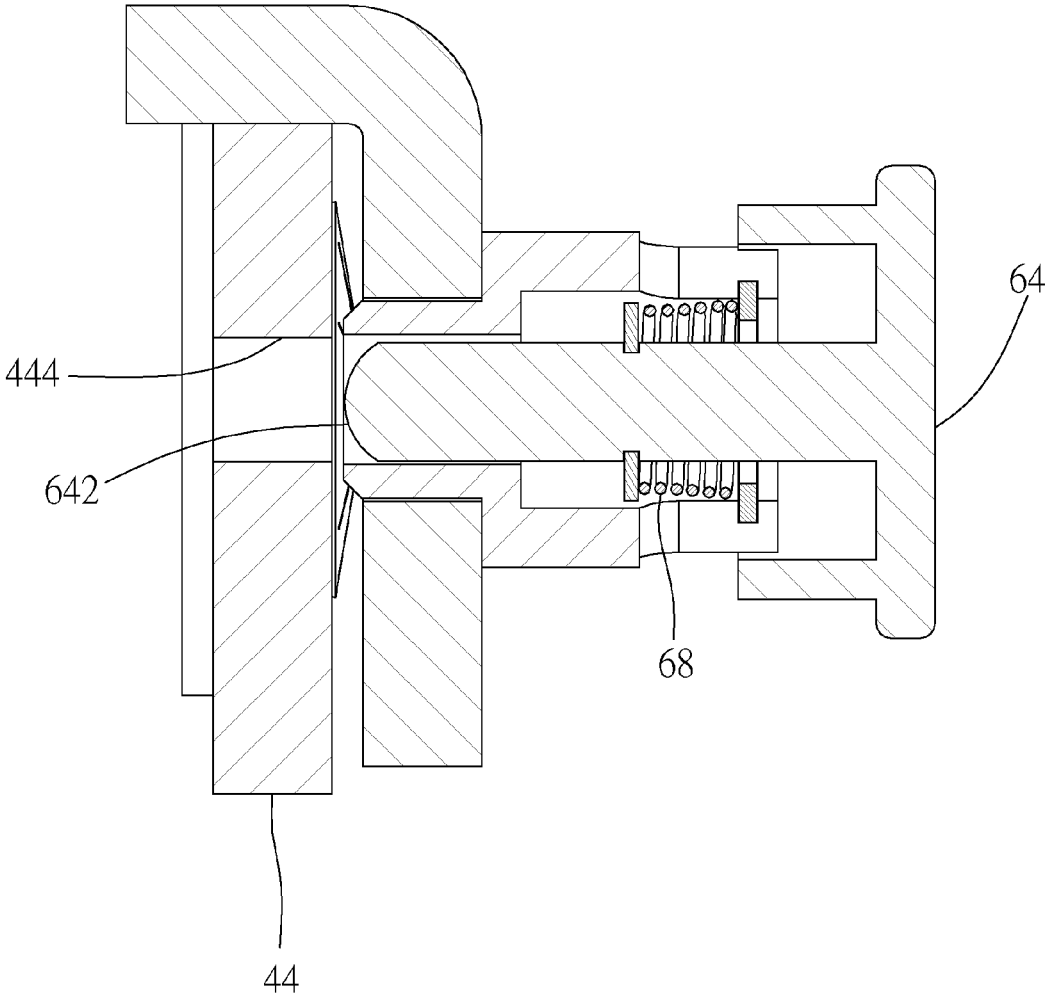
FIG. 5 is a sectional view along the 4-4 line in FIG. 2, showing the locking device is in the unlocking state.

As shown in FIG. 5, when the positioning pin 64 is pulled against the elastic force of the spring 68 to leave the positioning bore 444 of the second support 44, the first support 42 and the second support 44 are pivotally movable toward each other, which is defined as an unlocking state of the locking device 60.

Each of the two upper braces 50 pivotally connected to a second connecting member 14 of the upper loading board 10 and the connecting member 32 of the main shaft 30 with two ends thereof respectively, which is illustrated in FIG. 1. Each of the upper braces 50 includes a third support 52 and a fourth support 54 connected to each other, wherein the connection relation of the two supports 52 and 54 are the same in the preferred embodiment. Similarly, a locking device is installed on the upper brace 50 to keep the two supports 52 and 54 being arranged in a straight line to be in a supporting position. The structural relation of the locking device and the upper brace 50 is the same as the locking device 60 and the lower brace 40, and is not described in detail herein.

The foldable picking ladder cart 100 further includes a pair of handles 70 and a ladder 80. Each of the handles 70 is connected to the main shaft 30 with an end thereof, and the other end is a free end to be gripped by a user to control the foldable picking ladder cart 100. The ladder 80 is connected to the main shaft 30, and includes a plurality of steps arranged at intervals for a user to step on.

Figure 6:
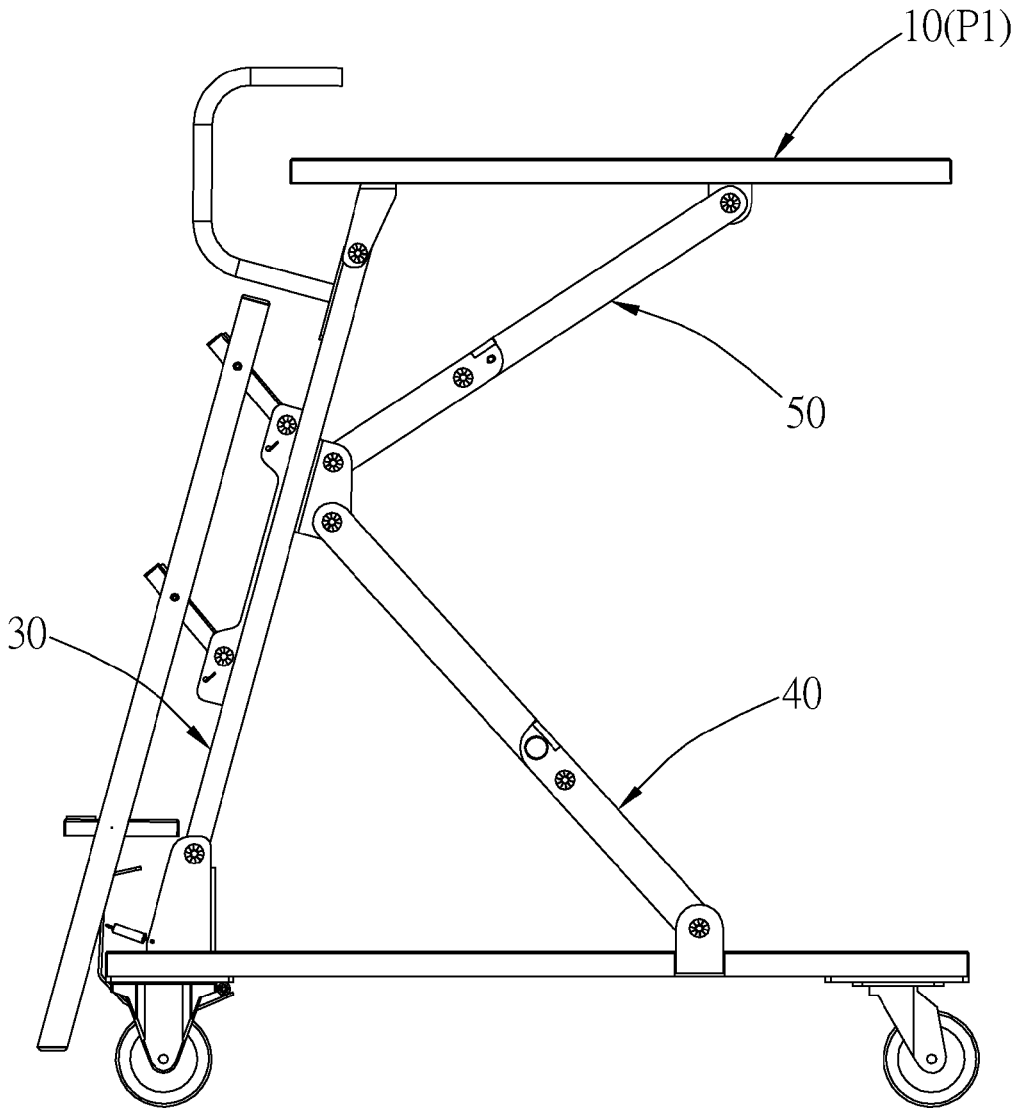
FIG. 6 to FIG. 10 are lateral views of the preferred embodiment, showing the folding process of the foldable picking ladder cart.
Figure 7:
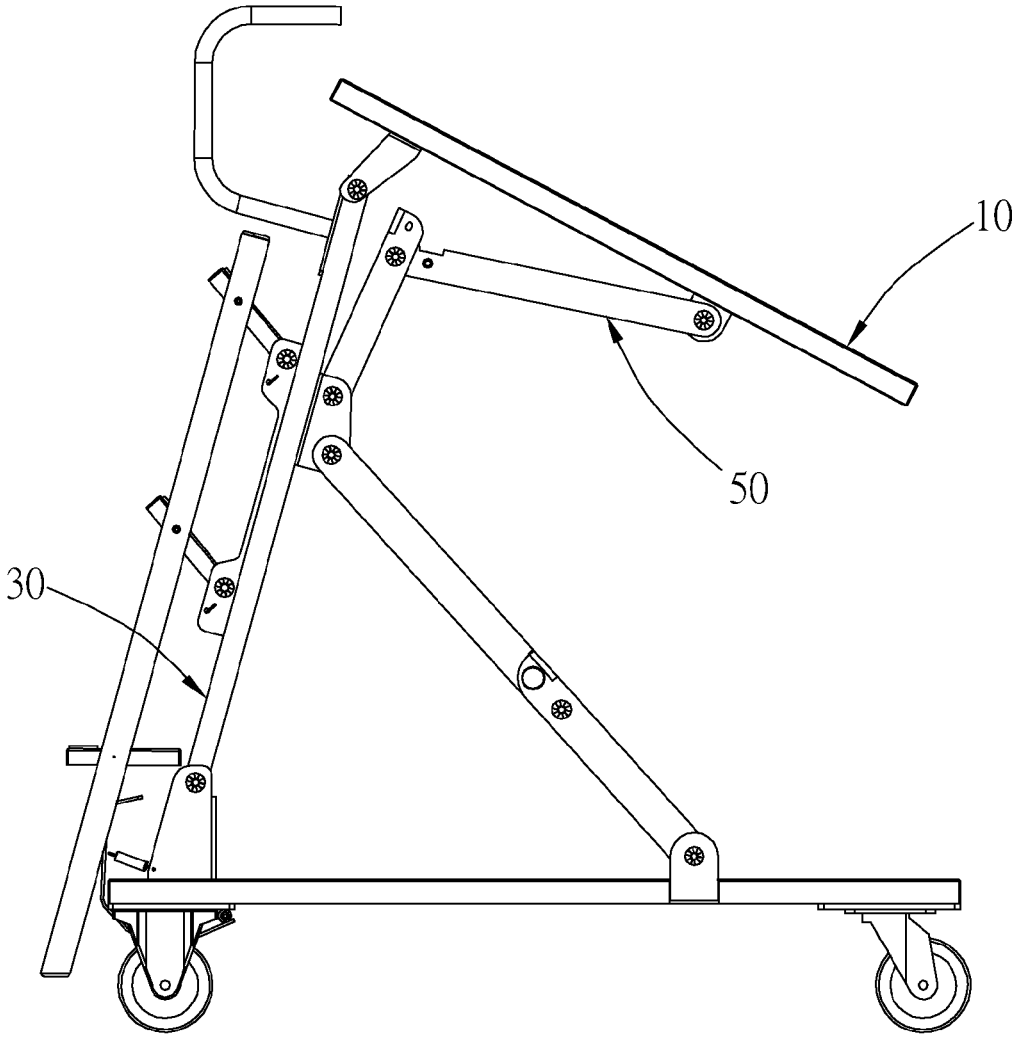
Figure 8:
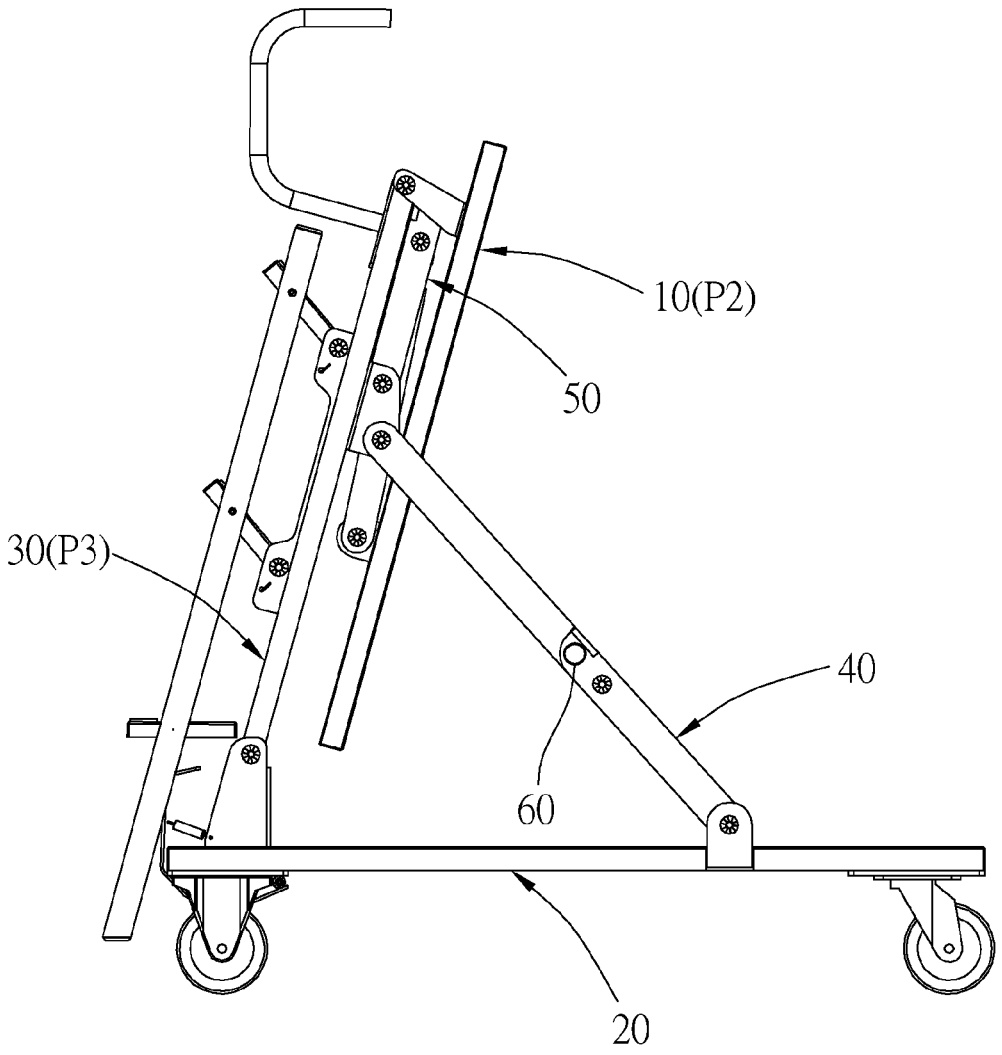
Figure 9:
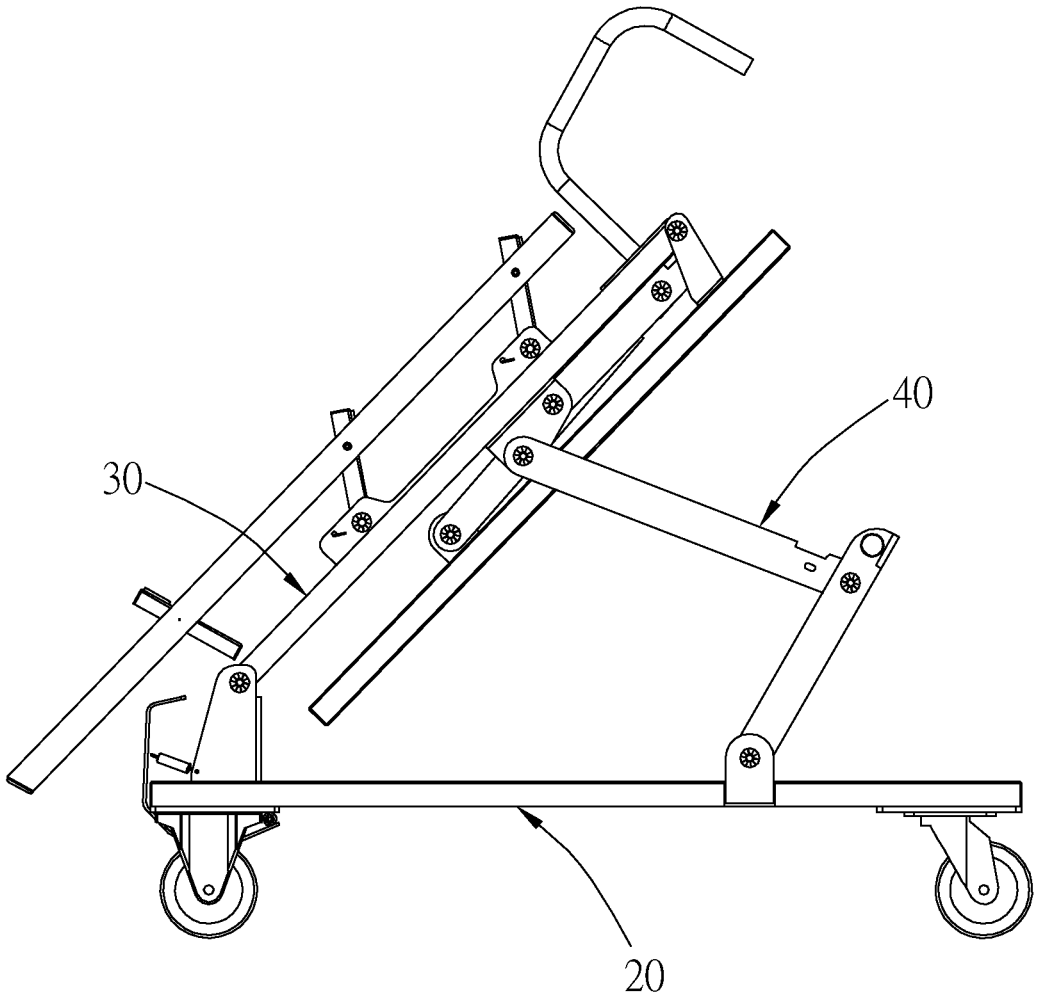
Figure 10:
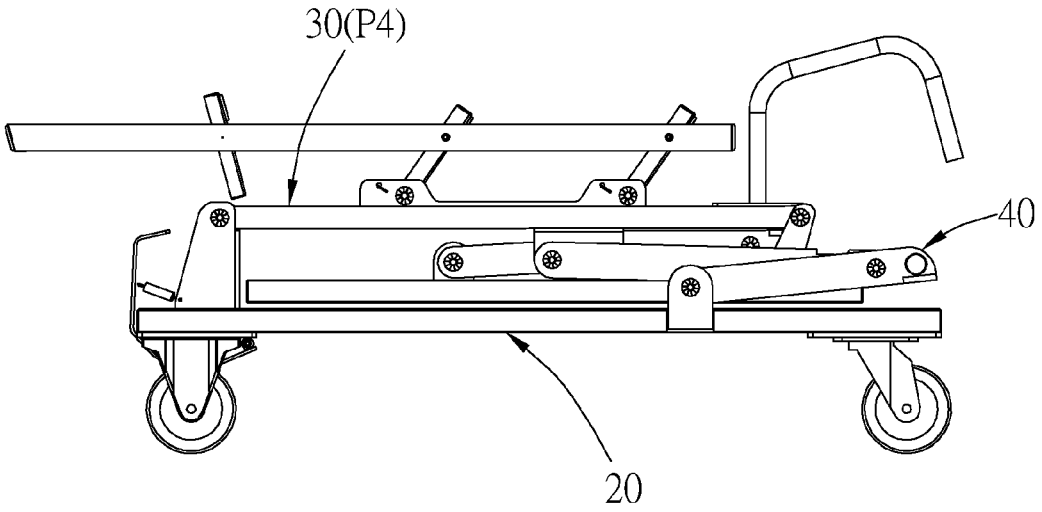
Figure 11:
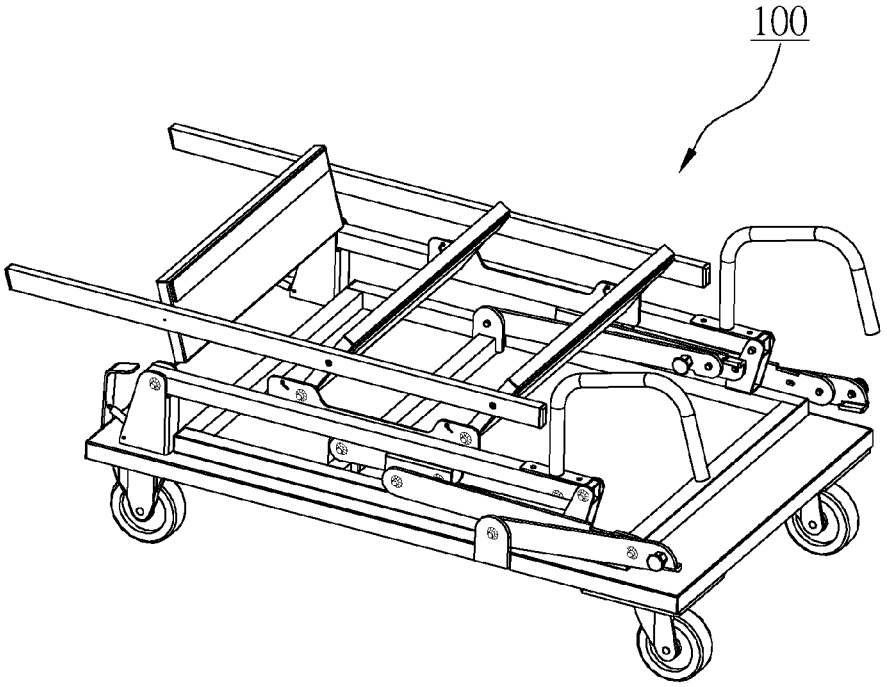
FIG. 11 is a perspective view of the preferred embodiment, showing the foldable picking ladder cart which is folded.

The folding process of the upper loading board 10 is illustrated in FIG. 6 to FIG. 8. When the locking device of the upper brace 50 is in an unlocking state, the upper loading board 10 is pivotally movable between a first position P1 and a second position P2 relative to the main shaft 30. On the other hand, the upper brace 50 is moved from the supporting position to a folded position when the upper loading board 10 is moved from the first position P1 to the second position P2. Next, the folding process of the main shaft 30 is illustrated in FIG. 8 to FIG. 10. When the locking device 60 of the lower brace 40 is in the unlocking state, the main shaft 30 is pivotally movable between a third position P3 and a fourth position P4 relative to the lower loading board 20; at the same time, the lower brace 40 is moved from the supporting position to the folded position, and the foldable picking ladder cart 100 is completely folded as shown in FIG. 11.

With the design of the lower brace 40 and the upper brace 50, the foldable picking ladder cart 100 is stable for loading goods through the support of the two braces 40 and 50. On the other hand, when the foldable picking ladder cart 100 is not in use, it can be folded in the way of the abovementioned folding process to reduce the occupied volume without detaching any parts thereof.

Additionally, the process from the folded state to the supporting state of the foldable picking ladder cart 100 is the reverse of the folding process shown from FIG. 6 to FIG. 10.

In addition, the connection relation of the supports of the braces is not limited to the way mentioned above. For example, using the washer 40*b* could reduce the friction generated by the pivotal moving of the supports, while in other embodiments, the washer 40*b* could be omitted. Furthermore, the supports connected by the shaft 40*a* and the cap nut 40*c* could be fixedly connected by a bolt and a nut, or a rivet, in other embodiments.

Additionally, for other embodiment with a simpler structure, the locking device 60 could be substituted by other locking members, such as carabiners and D buckles.

It must be pointed out that the embodiment described above is only a preferred embodiment of the present invention. All equivalent structures which employ the concepts disclosed in this specification and the appended claims should fall within the scope of the present invention.

What is claimed is:

1. A foldable picking ladder cart, comprising:

a main shaft; a ladder connected to the main shaft;

an upper loading board pivotally connected to an end of the main shaft, wherein the upper loading board is pivotally movable between a first position and a second position relative to the main shaft without being detached from the main shaft;

a lower loading board pivotally connected to another end of the main shaft, wherein the main shaft is pivotally movable between a third position and a fourth position relative to the lower loading board; a plurality of wheels are installed at a bottom of the lower loading board;

an upper brace pivotally connected to the upper loading board and the main shaft with two ends thereof respectively, wherein the upper brace is pivotally movable between a supporting position and a folded position; when the upper brace is in the supporting position, the upper loading board is in the first position; when the upper brace is in the folded position, the upper loading board is in the second position; and a lower brace pivotally connected to the main shaft and the lower loading board with two ends thereof respectively, wherein the lower brace is pivotally movable between a supporting position and a folded position; when the lower brace is in the supporting position, the main shaft is in the third position; when the lower brace is in the folded position, the main shaft is in the fourth position;

each of the upper brace and the lower brace comprises two supports respectively, and the two supports are pivotally connected to each other; when the upper brace or the lower brace is in the supporting position, the two supports thereof are arranged in a straight line with a straight angle formed between the two supports; when the upper brace or the lower brace is in the folded position, the two supports thereof overlap; one of the two supports of each of the upper brace and the lower brace has an engaging portion which engages the other support when the two supports are arranged in a straight line.

2. The foldable picking ladder cart of claim 1, wherein each of the supports which have the engaging portion has a stop piece protruding toward the other support, and the engaging portion is formed on the stop piece; the other support pivotally connected to said support has a recession thereon; when the two supports are arranged in a straight line, the stop piece is fitted into the recession, and the engaging portion engages an outer surface of the other support.

3. The foldable picking ladder cart of claim 1, further comprising two positioning pins, wherein for either of the upper brace and the lower brace, one of positioning pins is provided at where the supports connected to each other; the two supports of either of the upper brace and the lower brace have a positioning bore respectively; for either of the upper brace and the lower brace, the positioning bore of one of the supports corresponds to the positioning bore of the other one of the supports; the positioning pin is detachably inserted into the corresponding two positioning bores to keep the two supports being arranged in a straight line.

4. The foldable picking ladder cart of claim 3, further comprising a positioning base, a confining member, and a spring respectively for either of the upper brace and the lower brace; the positioning base has a hollow portion therein, and is fixed to one of the two supports with one end thereof, wherein the hollow portion aligns with the positioning bore of the relevant support; the positioning pin has a body and a head connected to each other, wherein the body is inserted into the hollow portion of the positioning base and the positioning bore of the other support, and the head abuts against another end of the positioning base; the confining member is fixed to the body of the positioning pin; the spring abuts against the confining member and a protruding ring of the positioning base with two ends thereof respectively, wherein the protruding ring is formed on an inner surface of the positioning base; the spring applies an elastic force to the positioning pin to keep the body of the positioning pin staying in the positioning bore of the other support; the two supports are pivotally movable toward each other if the positioning pin is pulled against the elastic force to leave the positioning bore of the other support.

5. The foldable picking ladder cart of claim 1, wherein the ladder comprises a plurality of steps arranged at intervals.

6. The foldable picking ladder cart of claim 1, further comprising a handle, wherein the handle is connected to the main shaft with an end thereof.

* * * * *